US009060614B1

(12) United States Patent
Gibilterra

(10) Patent No.: US 9,060,614 B1
(45) Date of Patent: Jun. 23, 2015

(54) PUBLIC SEATING SYSTEM WITH INTERCHANGEABLE AND REPLACEABLE MODULAR WEB-DESIGN SEATS AND BACKS

(71) Applicant: Charles Augustus Gibilterra, Carmel, CA (US)

(72) Inventor: Charles Augustus Gibilterra, Carmel, CA (US)

( * ) Notice: Subject to any disclaimer, the term of this patent is extended or adjusted under 35 U.S.C. 154(b) by 0 days.

(21) Appl. No.: 14/121,244

(22) Filed: Aug. 13, 2014

(51) Int. Cl.

| | |
|---|---|
| ***A47C 7/40*** | (2006.01) |
| ***A47C 7/22*** | (2006.01) |
| ***A47C 3/00*** | (2006.01) |
| ***A47C 7/54*** | (2006.01) |
| ***A47C 11/00*** | (2006.01) |

(52) U.S. Cl.
CPC ..... *A47C 11/005* (2013.01); *A47C 7/54* (2013.01); *A47C 7/40* (2013.01); *A47C 7/22* (2013.01); *A47C 3/00* (2013.01)

(58) Field of Classification Search
CPC ..... A47C 3/00; A47C 7/22; A47C 7/40; A47C 7/54; A47C 11/00
USPC ..... 297/232, 248
See application file for complete search history.

(56) References Cited

U.S. PATENT DOCUMENTS

| | | | | | |
|---|---|---|---|---|---|
| 2,812,800 | A * | 11/1957 | Eames | 297/239 |
| 3,226,071 | A * | 12/1965 | Eames et al. | 248/163.1 |
| 3,261,640 | A * | 7/1966 | Straits | 297/135 |
| 4,114,949 | A * | 9/1978 | Benoit | 297/450.1 |
| 5,470,128 | A * | 11/1995 | Kerkham | 297/232 |
| 5,671,975 | A * | 9/1997 | Muller | 297/445.1 |
| 5,984,417 | A * | 11/1999 | Wang | 297/440.14 |
| 6,095,603 | A * | 8/2000 | Hock | 297/232 |
| 6,113,186 | A * | 9/2000 | Holmes et al. | 297/248 |
| 6,491,345 | B1 * | 12/2002 | Shepard | 297/440.22 |
| 6,746,086 | B1 * | 6/2004 | Foster | 297/440.14 |
| 6,786,548 | B2 * | 9/2004 | Pearce et al. | 297/316 |
| D609,491 | S * | 2/2010 | Lievore | D6/381 |
| 7,845,725 | B1 * | 12/2010 | Sawhney | 297/248 |
| 8,240,771 | B2 * | 8/2012 | Diffrient | 297/452.56 |
| 8,764,107 | B2 * | 7/2014 | Kusch et al. | 297/248 |
| 2003/0094840 | A1 * | 5/2003 | Williamson | 297/248 |
| 2005/0146180 | A1 * | 7/2005 | Fisher et al. | 297/248 |
| 2007/0128407 | A1 * | 6/2007 | Kerr | 428/138 |
| 2011/0156448 | A1 * | 6/2011 | Fletcher | 297/16.1 |
| 2012/0299348 | A1 * | 11/2012 | Kusch et al. | 297/232 |
| 2013/0038103 | A1 * | 2/2013 | Scott | 297/248 |
| 2014/0159444 | A1 * | 6/2014 | Guering | 297/195.11 |

* cited by examiner

*Primary Examiner* — David R Dunn
*Assistant Examiner* — Timothy J Brindley

(57) ABSTRACT

A public or personal seating system with interchangeable modular web-design seats and backs is disclosed herein.

5 Claims, 12 Drawing Sheets

PUBLIC SEATING SYSTEM WITH INTERCHANGEABLE AND REPLACEABLE MODULAR WEB-DESIGN SEATS AND BACKS

CROSS-REFERENCE TO RELATED APPLICATION

This application claims the benefit of Provisional Patent Application Ser. No. 61/959,041, filed Aug. 13, 2013.

BACKGROUND OF THE INVENTION

1. Technical Field

This invention relates generally to public area seating systems, and in particular, but not by way of limitation, to public seating systems having seats and backs that are modular in appearance, dimensions, and construction.

2. Background of the Invention

There is a substantial amount of public area seating that, through design, manufacturing, or installation shortcomings, has failed to fully satisfy the needs of the people that use such public area seating.

The prior art contains numerous examples of public seating chairs and benches for airports, train stations, and the like in various configurations and designs. These chairs typically have one or more seats linearly attached in a row to a supporting frame, a backrest attached to each seat, and a number of legs attached to the supporting frame.

However, the devices disclosed by the prior art had numerous disadvantages. Specifically, most, if not all of these public seating chairs use a seat component that has dimensions different from than the back component thereby requiring two separate components for manufacture, storage, shipping, assembly, and replacement/repair of the public seating system. This problem was addressed in U.S. Pat. No. 3,226,071 issued to C. Eames et al (1961) which disclosed seating having replaceable modular seats and backs that were contoured and constructed using a padded material for individual comfort. Similarly, U.S. Pat. No. 5,671,975 issued to Muller (1997) discloses a seating system with a horizontal bar having modular seat and back portions attached thereto. U.S. Pat. No. 6,491,345 issued to Shepard discloses a seat having interchangeable inserts that can be used as a seat or a back for the seating system.

The present invention contemplates a further improvement to the prior art in that the modular seats and backs are interchangeable (having the same dimensions), easily replaceable to facilitate maintenance and repair, and reversible to permit the user to simply flip the seat or back over when scratched or soiled, thereby extending the usable life of the component.

While the foregoing prior art disclosures addressed the problem of differing seat and back construction, there remained other problems associated with most public seating systems. For example, most public seating disclosed by the prior art contemplates the use of cantilevered seating whereby the rear of the seat is attached to a horizontal bar and extends forward at a right angle to that support bar. By way of example, U.S. Pat. No. 3,225,071 issued to C. Eames et al. (1965); U.S. Pat. No. 3,261,640 issued to Straits (1966); U.S. Pat. No. 3,568,967 issued to Furtak (1971); U.S. Pat. No. 5,671,975 issued to Muller (1997); U.S. Pat. No. 5,984,417 issued to Wang (1999); U.S. Pat. No. 6,746,086 issued to Foster5 (2004); and U.S. Pat. No. 7,845,725 issued to Sawhney (2010) all disclose or contemplate cantilevered seating. Similarly, U.S. Patent Applications 2007/0128407 filed by Kerr; 2012/0299348 disclosed by Kusch et al; and Chinese Patent Number CN202664848 also disclose or contemplate the use of cantilevered seating. U.S. Pat. No. 6,786,548 addressed this problem to a limited extent by placing a single seat on a tubular frame which reduced the amount of the seat overhanging or cantilevered over the support structure.

While the use of cantilevered seating offers many economic advantages, it requires the use of strong, rigid, and often bulky structural components to accommodate the transfer of stress to the point of attachment. Sitting on the edge of a cantilevered seat places undue stress on its outermost extremity which often leads to structural failure; it also places undue strain on the structural support components which causes them to loosen or ultimately fail as well. Finally, sitting on the edge of a cantilevered seat can cause it to tip over and possibly injure the user. The present invention addresses these limitations by using an inverted starfish-shaped seat support structure that more evenly distributes the stress imparted onto the seat by the weight of the user.

The prior art contains numerous examples of public seats that have been designed to provide a more comfortable seating option than that afforded by the original flat, wooden bench or church pew. Accordingly, hundreds of different design, shape, and padding options populate the prior art disclosures. U.S Design Pat. No. D609,491 issued to Lievore (2010) and U.S. Pat. No. 3,261,640 disclose a sculpted bench seat that has curves to more comfortably encompass the users' hips and back; U.S. Pat. No. 3,226,071 issued to C. Eames et al. (1961) discloses a padded seat that would provide a softer, more comfortable seating surface to the user. U.S. Pat. No. 4,114,949 issued to Benoit (1978); U.S. Pat. No. 5,671,975 issued to Muller (1997); and U.S. Pat. No. 8,240,771 issued to Diffrient disclose seating systems using a strong and durable cloth-mesh-type of material stretched over the support frames as the seats and backs of the devices disclosed therein.

While these solutions, as well as many others disclosed by the prior art certainly provide the user with a seating surface that is more comfortable than the tradition bench or church pew, they are not without limitations either. Most if not all of these devices are bulky and/or cumbersome in shape and thus difficult to transport and store. Many are made of rigid inflexible material which will not permit the seat or back to move with the user; while the shape of the seat or seat back may conform to the user's body more than the flat bench or church pew, the seat still cuts off the user's circulation forcing the user to continually shift his/her position in the seat to remain comfortable. Further, these materials do not allow for any air circulation between the user and the seat or seat back thereby causing the user to perspire from the skin surfaces in contact with the seat or seat back. Many that use flexible materials distend to the point where the user's skin extrudes through the seat materials or openings which, again, cuts off the user's circulation.

The present invention addresses these issues with a totally flat web-design seat/seat back. Since it is flat, it can be easily stored and transported because it takes up a minimal amount of storage room. Because of its composition it is flexible and moves with the movements of the user. Because of its web-mesh design, it "breathes" permitting some air circulation around the seat and the seat back. Finally, the web design transfers the weight of the user symmetrically from the point of contact to the points where the seat is anchored to the seat support structure. Transferring the weight in this manner significantly reduces the likelihood of cutting off the user's blood circulation while sitting on the present invention.

Objects and Advantages

The present invention seeks to overcome these shortcomings by providing an improved public seating system that is simple in construction, ergonomically efficient, and durable while still meeting the stated needs of the general public and the facilities that service the general public for a reasonably priced piece of furniture that is comfortable and easy to clean and maintain or repair. Accordingly, the objects and advantages of the present invention are:

(1) To provide a public seating system with replaceable and interchangeable modular web-design seats and backs.

(2) To provide a public seating system with seats and backs made of "breathable" materials that permit circulation near and around the surfaces where the user comes into contact with the seat and seat back.

(3) To provide a public seating system with seats and backs made of durable materials.

(4) To provide a public seating system with seats and backs made of materials that can be quickly and easily cleaned.

(5) To provide a public seating system with seats and backs that can be quickly and easily replaced as necessary.

(6) To provide a public seating system with seat and back components that evenly distribute the weight of the user through the web-design incorporated into the modular seat and seat-back components.

(7) To provide a public seating system with seats and backs made of flexible materials that adapt to changes in the user's body position.

(8) To provide a public seating system with seats and backs made of flexible materials (as opposed to hard materials such as metal or plastic) thereby reducing restriction of the user's blood circulation.

(9) To provide a public seating system with seats and backs made of flexible materials but are still firm enough to preclude the user's skin and or clothing from protruding through the seat/back opening and "telegraphing the user's body shape.

(10) To provide a public seating system with seats and backs that are flat and thereby easy to store, pack, and ship as components.

(11) To provide a public seating system that can use interchangeable modular seats and backs that are reversible.

(12) To provide a public seating system that is durable in construction so as to provide lasting performance in the face of constant use in a public area.

(13) To provide a public seating system that is economical to manufacture.

(14) To provide a public seating system that can use off-the-shelf technology and components.

(15) To provide a public seating system that uses a minimal number of component parts thereby increasing its economic value.

(16) To provide a public seating system that utilizes replaceable modular seating supports thereby providing ease of access and replacement to maintenance personnel.

(17) To provide a public seating system that can use recyclable, earth-friendly components.

(18) To provide a public seating system that is both functional and aesthetically pleasing.

(19) To provide a public seating system with a tubular extruded aluminum beam support for attachment of its seating armatures & arm armature supports, for functional simplicity, and lighter structural weight, as well as aesthetic beauty.

(21) To provide a public seating system that can be used in most public seating venues where sanitation, comfort, and ease of maintenance and repair are required including, without limitation, airports, train and bus stations, museums and other such public galleries, parks and recreation areas, sporting arenas and stadiums, public waiting and rest areas, and the like.

(20) To provide a public seating system that can be used in any seating venue where the seat and back of the chair/seat are interchangeable.

Additional objects, advantages, and novel features of the invention will be set forth in part of the description which follows and will become apparent to those skilled in the art upon examination of the following specification, or will be learned through the practice of the present invention.

DRAWINGS

DESCRIPTION OF THE INVENTION

Reference Numerals

10—Public seating system
20—Support assembly
21—Support beam
211—Channel
212—Connecting screw
213—Connecting screw opening
214—Support beam cavity
22—Side support member
221—Leg
222—Inside Recess
223—Outside Recess
224—Anti-rotation Extension (not shown)
30—Seat assembly
301—Modular tension membrane
302—Modular tension membrane ribbing
303—Modular tension membrane perforation
31—Seat support member
311—Seat support mounting sleeve
312—Anti-rotation extension
313—Back support mounting plate
314—Membrane attachment screw
315—Seat support cylindrical base
32—Arm rest
321—Arm rest mounting sleeve
322—Anti-rotation extension
323—Arm rest pad
40—Back assembly
401—Modular tension membrane
41—Back support member
411—Membrane attachment screw
412—Back assembly attachment screw
413—Modular tension membrane ribbing
414—Modular tension membrane perforation

DESCRIPTION

Figure 1:
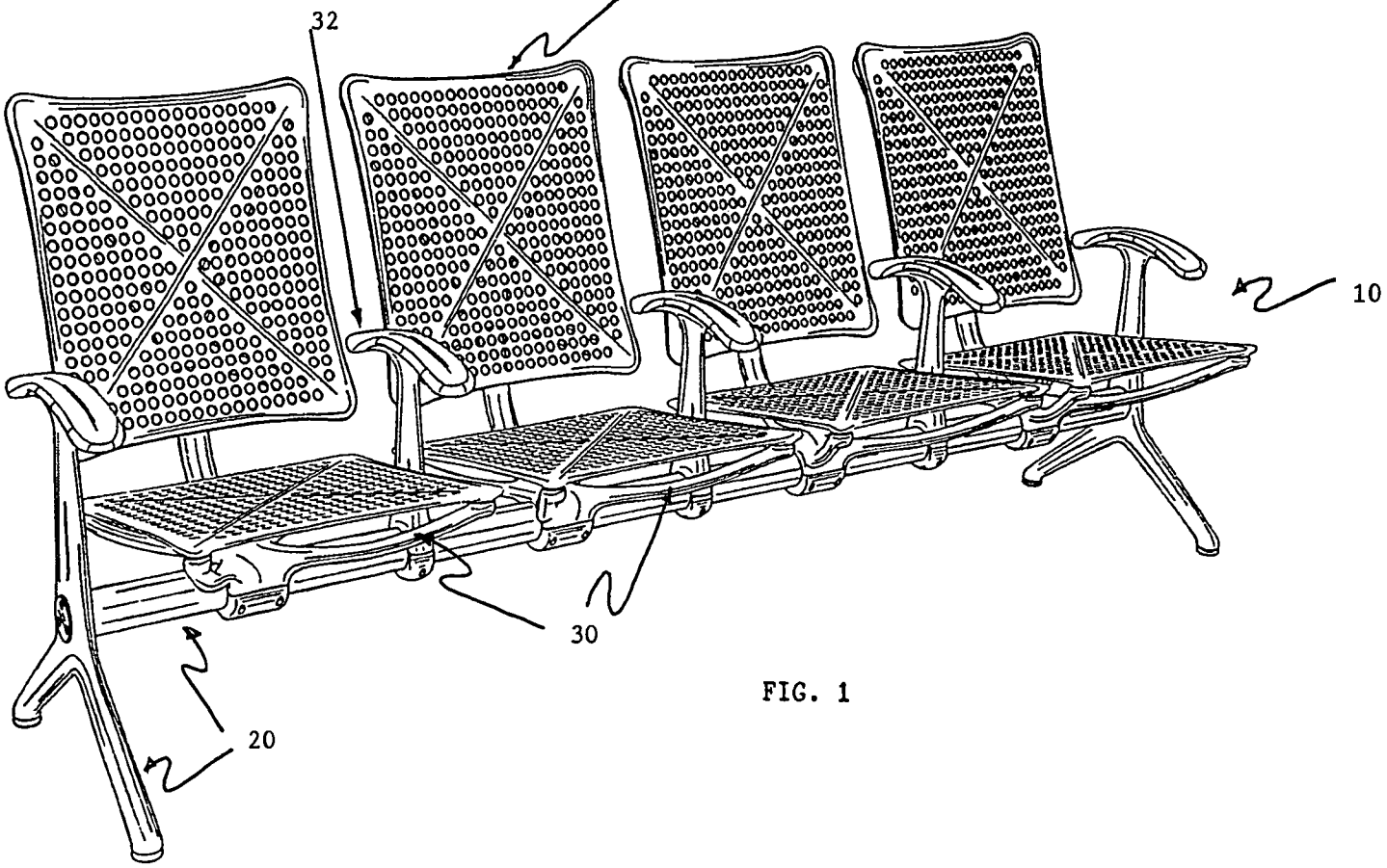
FIG. 1 is a front-left perspective view of the device.

FIG. 1 shows a perspective view of the present invention. This public seating system (10) consists of a support assembly (20) that provides structural support for a seat assembly (30) with an arm rest (32), and a back assembly (40). FIG. 1 shows the arm rest (32) as part of the support assembly (20) at opposite ends of the public seating system (10) as well as individually positioned between each seat depicted herein. While FIG. 1 shows a public seating system (10) with four individual seats, the present invention contemplates embodiments having one to six individual seats. The present invention also contemplates seating for other venues such as personal (home or office) use where the user appreciates the concept, efficiency, and economy of a chair with an interchangeable seat and back component.

Figure 2:
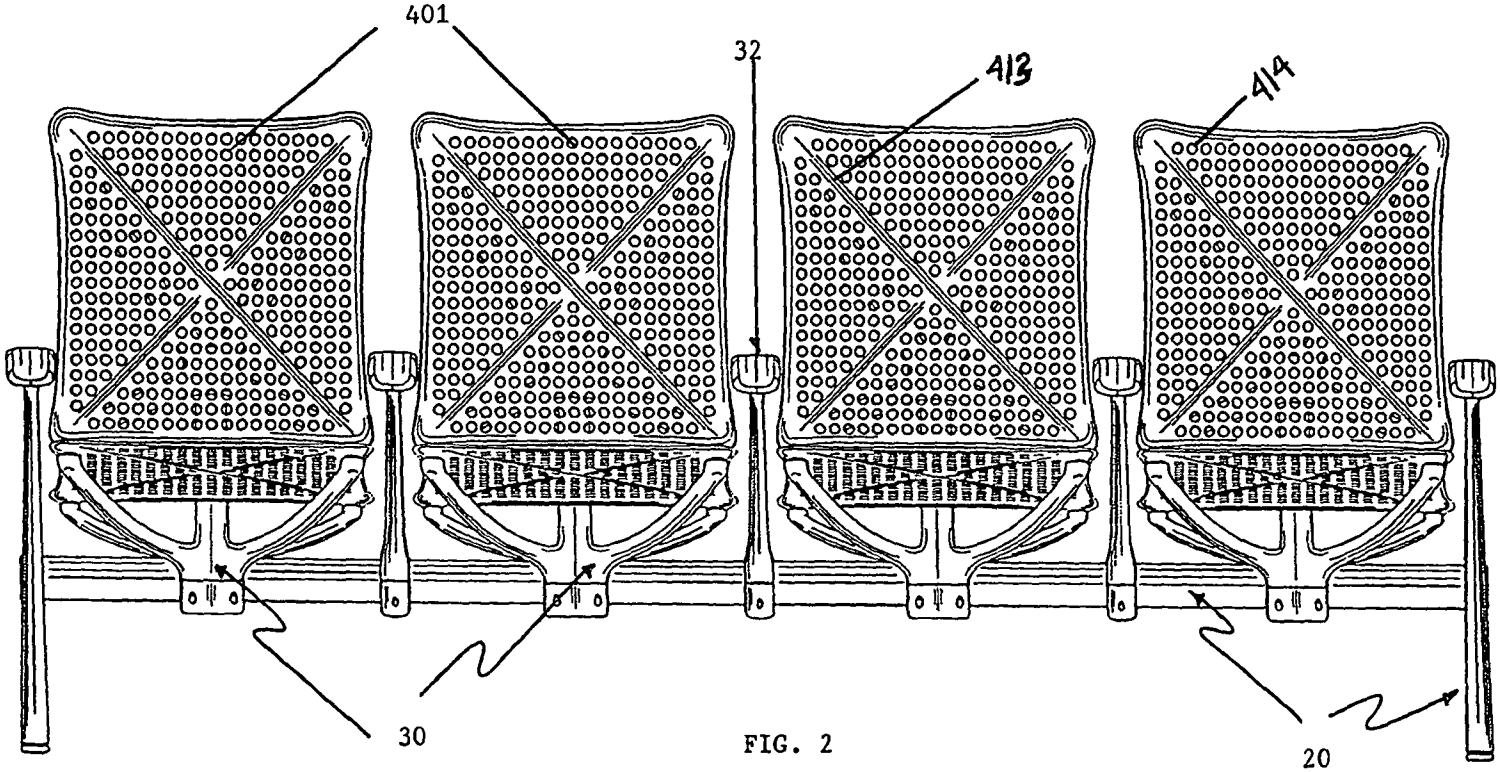
FIG. 2 is a front elevation view of the device.
Figure 3:
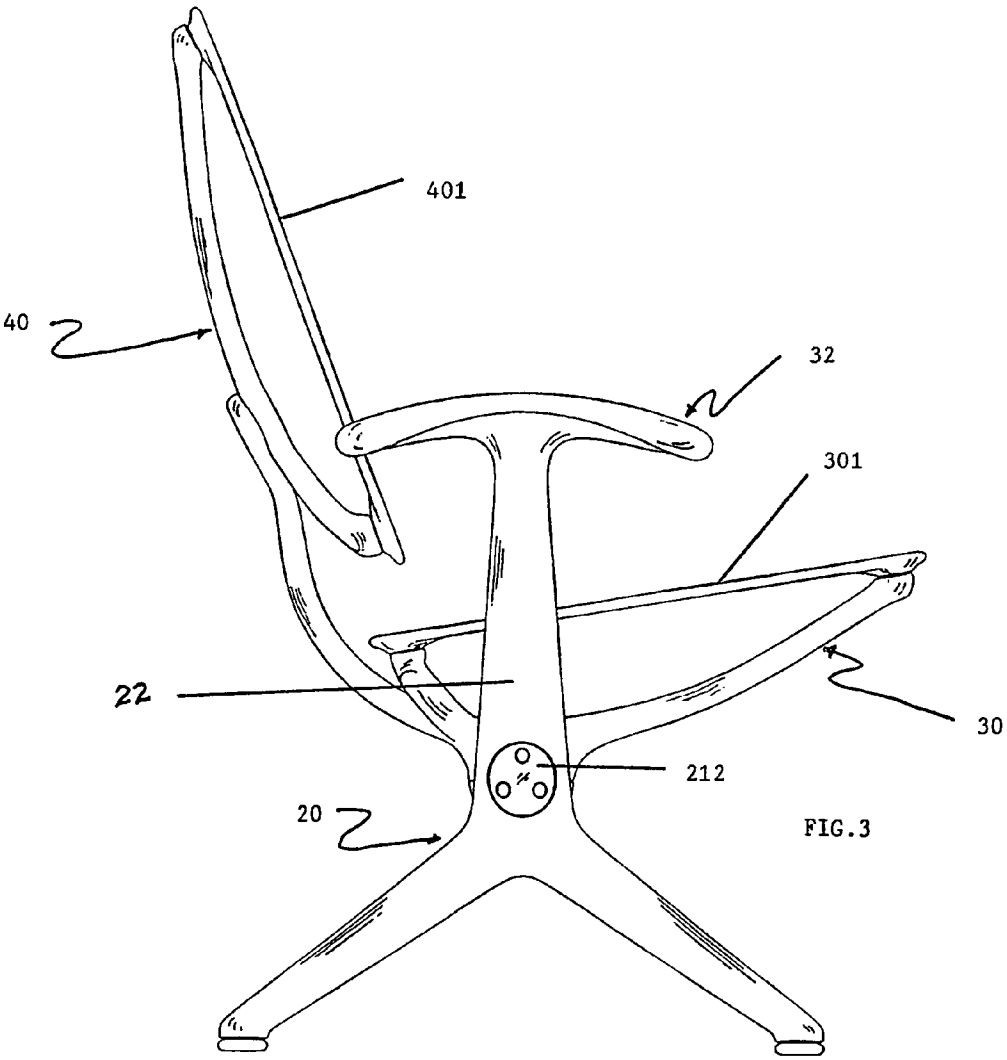
FIG. 3 is a left side elevation view of the device which is identical to the right side elevation view.
Figure 4:
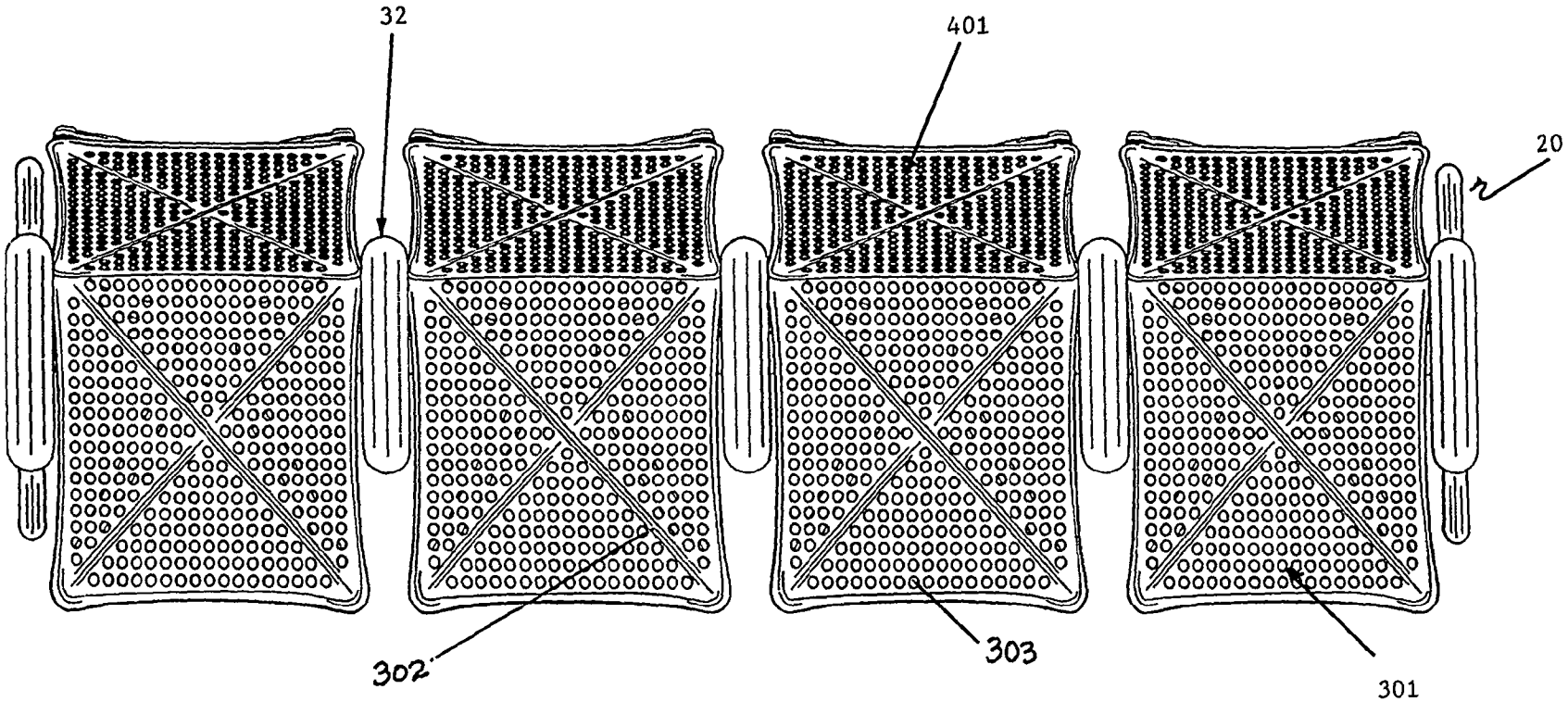
FIG. 4 is a top-downward looking plan view of the device.

FIG. 2 is a front elevation view of the present invention which gives a better depiction of the support assembly (20), the seat assembly (30) and the arm rests (32) as individually mounted between each seat. FIG. 2 also shows the modular tension membrane (401) attached to the back assembly (40). This modular tension membrane (401) is exactly the same as the modular tension membrane (301) attached to the seat assembly (30) as seen in FIGS. 3 and 4. This modular tension membrane (401) is thus interchangeable with the other modular tension membrane (301) which adds to the overall economy of this public seating system (10). FIG. 2 also shows the functional design of the modular tension membrane (401) which channels the forces imposed by the user leaning into it equally and laterally along the X-shaped ribbing (413) extending outward from the center of the modular tension membrane (401) to each corner thereof. FIG. 2 also shows the modular tension membrane perforations (414) which permit the membrane to breathe and thereby reduce the likelihood of perspiration on the part of the user.

FIG. 3 is a side elevation of the present invention showing the side of the support assembly (20), the seat assembly (30), the arm rest (32), and the back assembly (40). FIG. 3 shows the arm rest (32) as integrated into the support assembly (20) but the present invention contemplates an arm rest (32) that is cast or molded separately as well as uniformly molded or cast as part of the side support member (22). FIG. 3 also shows the seating modular tension membrane (301) mounted on the seat assembly (30) as well as the back modular tension membrane (401) mounted on the back assembly (40). Finally, FIG. 3 shows the connecting screw (212) which connects the side support member (22) to the support beam (21) which is better depicted in FIG. 7 below.

FIG. 4 is a top-down plan view of the present invention that gives an excellent depiction of the modular tension membrane (301) on the seat assembly (30). As with the modular tension membrane (401) on the back assembly, this modular tension membrane (301) is exactly the same as the modular tension membrane (401) attached to the back assembly (40) as seen in FIGS. 3 and 4. This modular tension membrane (301) is thus interchangeable with the other modular tension membrane (401) which adds to the overall economy of this public seating system (10). FIG. 4 also shows the functional design of the modular tension membrane (301) which channels the forces imposed by the user sitting on it equally and laterally along the X-shaped ribbing (302) extending outward from the center of the modular tension membrane (301) to each corner thereof. FIG. 4 also shows the modular tension membrane perforations (303) which permit the membrane to breathe and thereby reduce the likelihood of perspiration on the part of the user.

Figure 5:
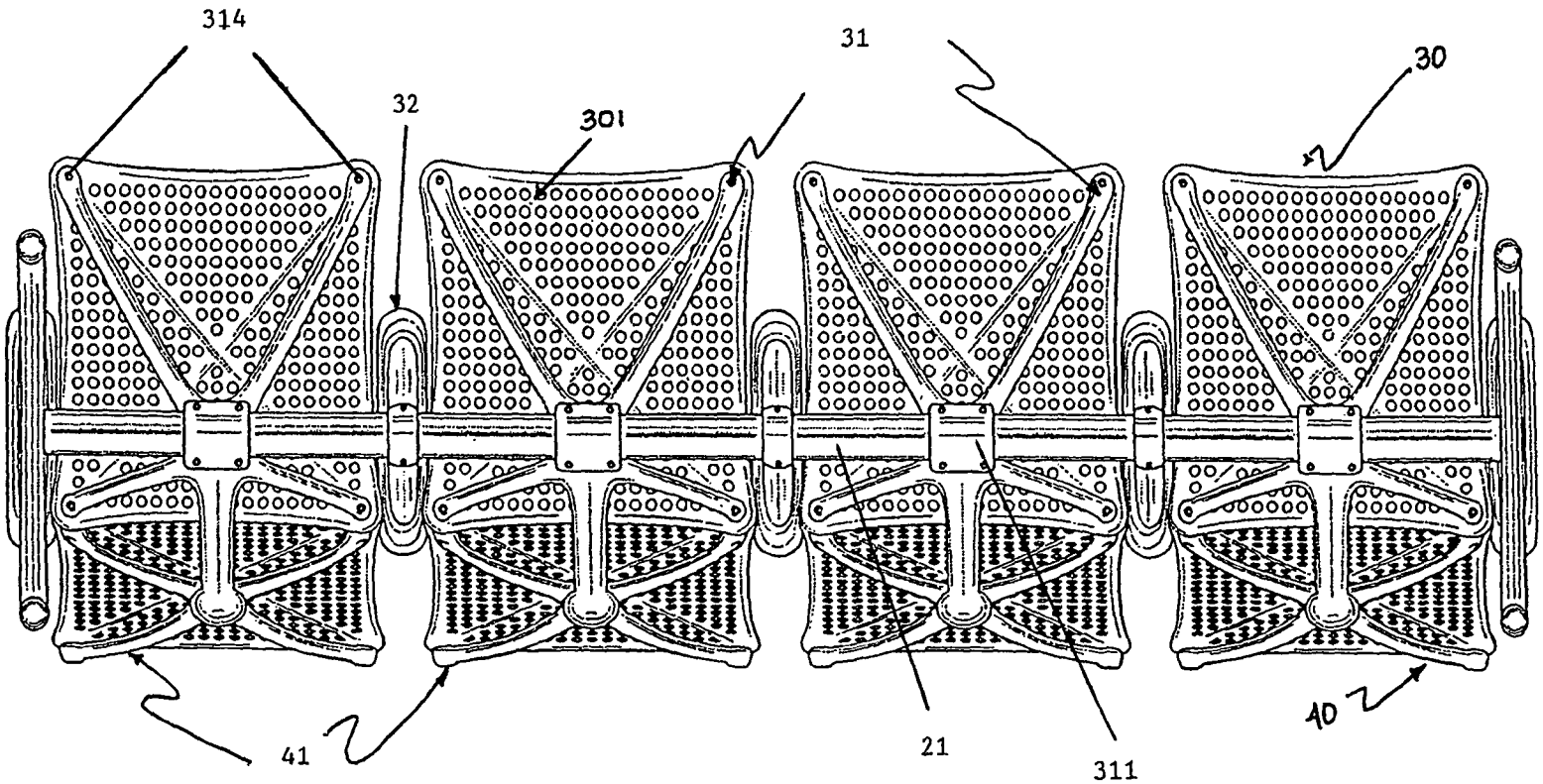
FIG. 5 is a bottom-upward looking plan view of the device that shows the underside of the device.

FIG. 5 is a bottom-up plan view of the present invention giving a good depiction of the seating assembly (30) and the back assembly (40). FIG. 5 shows the horizontal support beam (21) to which the seat assembly (30) and the arm rests (32) are attached. It also shows the cylindrically-shaped seat support mounting sleeve (311) which surrounds the lower half of the support beam (21) and is coupled to the underside of the seat assembly (30). FIG. 5 also gives a good depiction of the starfish-shape of the seat support members (31) while also showing the location of the membrane attachment screws (314) which firmly attach the modular tension membrane (301) to the seat support member (31)

Figure 6:
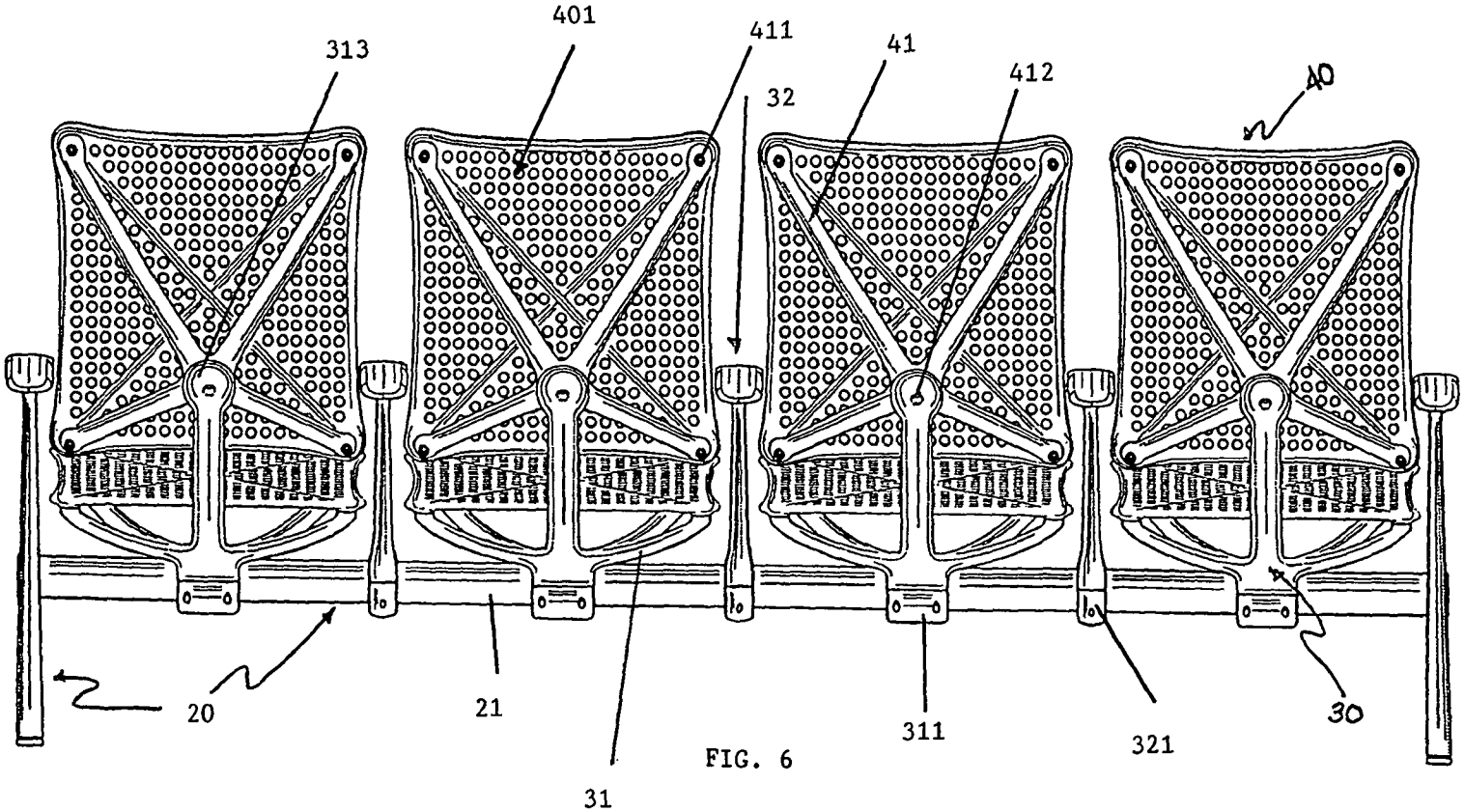
FIG. 6 is a rear elevation view of the device.

FIG. 6 is a rear elevation view of the present invention giving an excellent depiction of the support assembly (20), the seat assembly (30), and the back assembly (40). FIG. 6 gives a good depiction of the starfish-shaped back support member (41) as well as how the back assembly (40) is attached to the seat assembly (30) at the back support mounting plate (313) using the back assembly attachment screw (412). FIG. 6 also shows the seat support mounting sleeve (311) and the arm rest mounting sleeve (321) which are both cylindrically-shaped and surround the under half of the support beam (21) to couple with the seat support member (31) and the arm rest (32) respectively.

Figure 7:
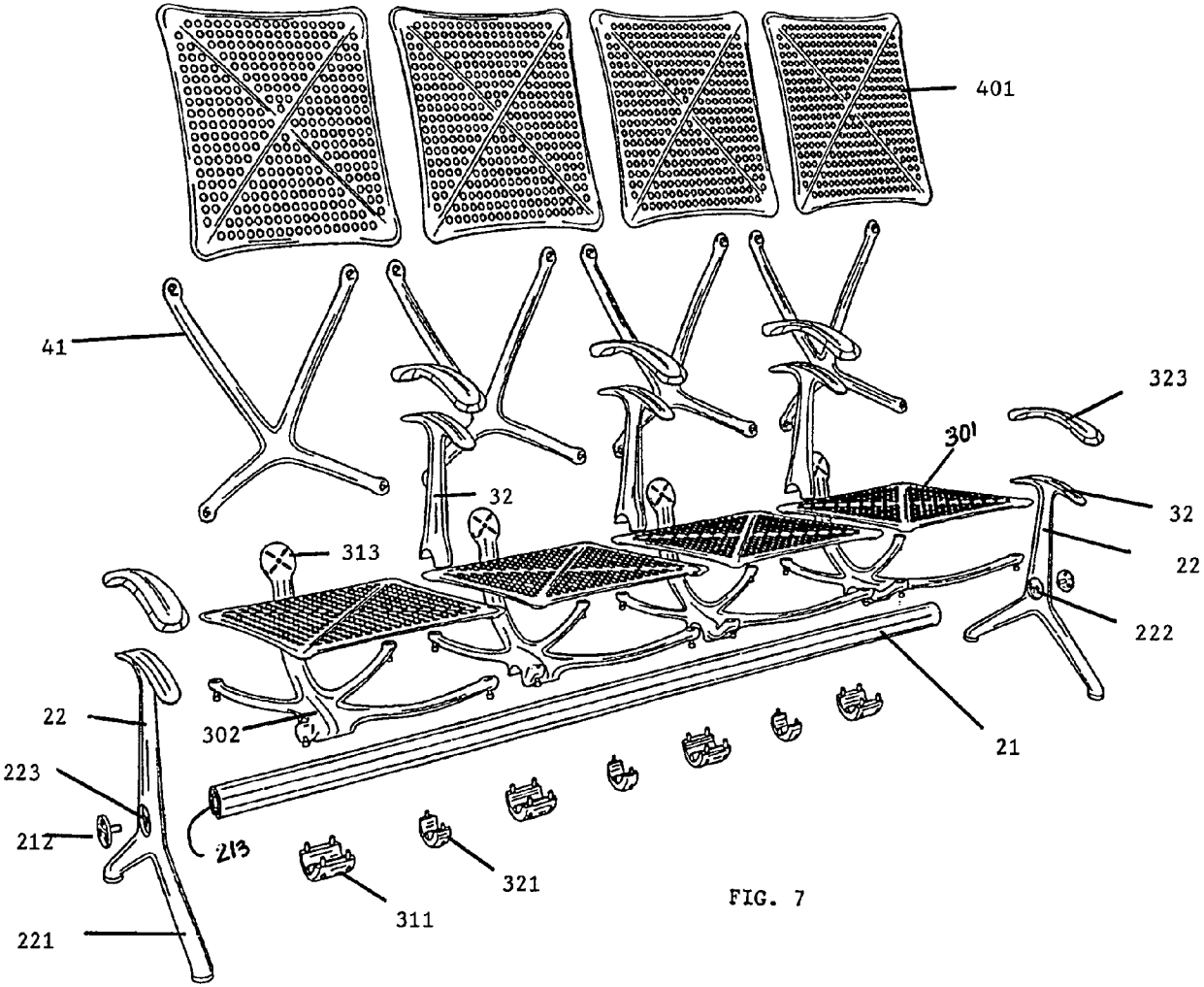
FIG. 7 is a front-left side exploded perspective view of the device that shows all of the component parts of the device in spatial relation to one another.
Figure 7A:
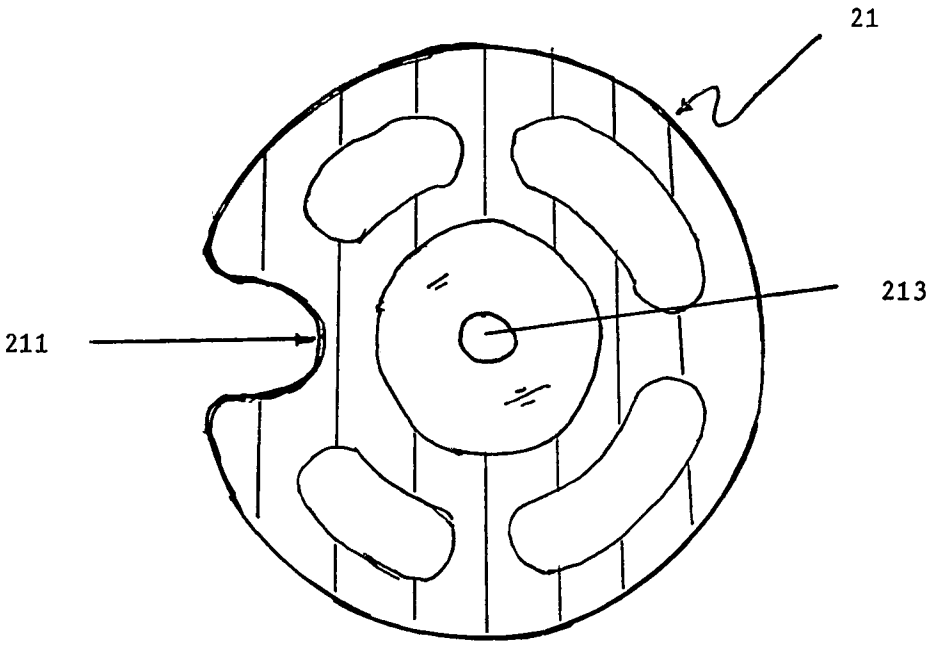
FIG. 7A is a cross-sectional view through the support beam.

FIG. 7 is an exploded perspective view of the present invention that shows all of the components for the four-seat embodiment in a spatial relationship to each other while FIG. 7A is a cross-sectional view of the support beam (21). Referring to FIG. 7, the public seating system (10) consists of a support assembly (20) that provides structural support for a seat assembly (30), an arm rest (32), and a back assembly (40). The structural support system (20) consists of a generally cylindrical support beam (21) with, Referring to FIG. 7A, a longitudinal channel (211) is cut or etched into the bottom of the support beam (21) and runs the entire length of the support beam (21). For aesthetic purposes, this channel (211) can be etched or cut in specific locations along the bottom of the support beam (21) to fit over anti-rotation extensions, i.e., ridges (224), (312) found in the side support member (22) and the seat support mounting sleeve (311). Referring to FIG. 7 and FIG. 7A, a connecting screw (212) fits into a connecting screw opening (213) on both ends of the support beam (21) and attaches the side support member (22) to the support beam (10). The support beam (10) is typically made of aluminum because of its light weight but it may be composed of any material suitable for structural members of this type including, without limitation, any strong and durable metal such as steel or stainless steel, plastic, rubber, structural composite materials, and the like. Accordingly, the support beam (21) can be manufactured by any number of processes including, without limitation, casting, molding, extrusion, and the like. In an alternative embodiment, the support beam (10) has an elliptical cross-section which raises the possibility of other curved cross-sections such as, without limitation, an oblate spheroid, an oval, or a race-track oval as well.

The side support member (22) is fabricated in an inverted Y-shape with the prongs of the Y-shape directed downward and forming the legs (221) of the public seating system (10). Two cylindrical recesses (222,223) are countersunk into the neck of the Y-shaped side support member (22). The end of the support beam (10) fits snugly into inside recess (222) while the connecting screw (212) fits snugly into the outside recess (223) as it is screwed into the connecting screw opening (213) until the surface of the connecting screw (212) is flush with the outer surface of the side support member (22). The inside recess (222) has an anti-rotation extension (224) (not shown on FIG. 7) protruding upward so as to fit snugly into the channel (211) on the underside of the support beam (21) so as to prevent rotation of the support beam (21). The side support member (22), like the support beam (10) is typically made of aluminum because of its light weight but it may be composed of any material suitable for structural members of this type including, without limitation, any strong and durable metal such as steel or stainless steel, plastic, rubber, structural composite materials, and the like. Accordingly, the side support member (22) can be manufactured by any number of processes including, without limitation, casting, molding, extrusion, and the like.

The seat assembly (30) consists of the seat support member (31), a modular tension membrane (301) that is attached to the seat support member (31), and an arm rest (32). The seat assembly has a concave-starfish shape with each of the five support members (31) curving upward. The seat assembly (30) is attached to the support beam (21) by means of a cylindrical seat support mounting sleeve (311) that fits snugly around the support beam (21) and is bolted to the bottom of the seat assembly (30) which has a cylindrical base (315). The seat support mounting sleeve (311), like the inside recess (222), has an anti-rotation extension (312) protruding upward so as to fit snugly into the channel (211) found on the underside of the support beam thereby preventing the assembly (30) from rotating around the support beam (21) when the user shifts position. The distal end of the middle seat support member (31) is flattened into a circular back support mounting plate (313) to which the back assembly (40) is attached. The distal ends of the other four seat support members (31) are flattened with threaded holes therein so as to present a horizontal surface to receive the modular tension membrane (301). The seat support members (31), like the support beam (10) are typically made of aluminum because of its light weight but it may be composed of any material suitable for structural members of this type including, without limitation, any strong and durable metal such as steel or stainless steel, plastic, rubber, structural composite materials, and the like. Accordingly, the seat support member (31) can be manufactured by any number of processes including, without limitation, casting, molding, extrusion, and the like.

The modular tension membrane (301) is essentially the seat (and as we see later, the back) of the public seating system (10). The modular tension membrane (301) is generally rectangular in shape, flat, perforated, and attached to the seat support member (31) by a series of membrane attachment screws (314) (not shown). The modular tension membrane (301) is generally composed of an elastomeric material that is flexible, durable, and easy to clean. Accordingly, materials such as DuPont Hytrel® thermoplastics, which can provide the desired flexibility, durability, and structural performance contemplated by the present invention, would be a suitable selection.

This modular tension membrane (301) provides many improvements over public seating options disclosed by the prior art. The modular tension membrane (301) is perforated which permits it to "breathe" thereby helping to keep the user's seating surfaces (legs, buttocks, and back) from perspiring. The spider-web design of the modular tension membrane (301) evenly distributes the forces applied to it to the four corners of its attachment points thereby reducing the likelihood that the user's blood circulation might be cut off. In one embodiment of the present invention, both sides of the modular tension membrane (301) can be identical and therefore, reversible giving maintenance personnel the option of simply "switching sides" instead of replacing a modular tension membrane (301) that has been cut, scratched, or marred in some manner. The composition of the modular tension membrane (301) lends itself to easy cleaning and stain resistance. The modular tension membrane (301) is flat and lightweight making it easy to store, ship, and handle. Finally the modular tension membrane (301) can be used as the seat for the public seating system (10) or the back of the public seating system (10). The modular tension membrane is just that: modular. The same modular component can be used as a seat or a back.

The arm rest (32) is a T-shaped component attached to the support beam (21). The arm rest (32) is attached to the support beam (21) by means of a cylindrical arm rest mounting sleeve (321) that fits snugly around the support beam (21) and is bolted to the bottom of the arm rest (32). The arm rest mounting sleeve (321), like the inside recess (222), has an anti-rotation extension (322) protruding upward so as to fit snugly into the channel (211) found on the underside of the support beam (21) thereby preventing the arm rest (32) from rotating around the support beam (21) when the user shifts position. The arm rest (32), like the support beam (10) is typically made of aluminum because of its light weight but it may be composed of any material suitable for structural members of this type including, without limitation, any strong and durable metal such as steel or stainless steel, plastic, rubber, structural composite materials, and the like. Accordingly, the arm rest (32) can be manufactured by any number of processes including, without limitation, casting, molding, extrusion, and the like. The arm rest (32) is covered with an arm rest pad (323) to provide an extra level of comfort to the user. The arm rest pad (323) can be reversible which serves to extend the service life of the arm rest pad (323).

The back assembly (40) consists of the back support member (41) and a modular tension membrane (401) that is attached to the back support members (41). The back support assembly (40) also has a concave-starfish shape with each of its four back support members (41) curving upward. The back assembly (40) is securely bolted to the back support mounting plate (313) found on the seat support member (31). The distal ends of the other four back support members (41) are flattened with threaded holes therein so as to present a horizontal surface to receive the modular tension membrane (401). The back support member (41), like the support beam (10) is typically made of aluminum because of its light weight but it may be composed of any material suitable for structural members of this type including, without limitation, any strong and durable metal such as steel or stainless steel, plastic, rubber, structural composite materials, and the like. Accordingly, the back support member (41) can be manufactured by any number of processes including, without limitation, casting, molding, extrusion, and the like.

The modular tension membrane (401) is essentially the back (and as we saw earlier, the seat) of the public seating system (10). The modular tension membrane (401) is generally rectangular in shape, flat, perforated, and attached to the back support member (41) by a series of membrane attachment screws (411). The modular tension membrane (401) is generally composed of an elastomeric material that is flexible, durable, and easy to clean. Accordingly, materials such as DuPont Hytrel thermoplastics, which can provide the desired flexibility, durability, and structural performance contemplated by the present invention, would be a suitable selection.

The modular tension membrane (401) used in the back assembly (40) can be interchanged with the modular tension membrane (301) used in the seat assembly (30). Being able to use the same component as the back or the seat of the public seating system (10) makes this system significantly more economical to manufacture. Further, the advantages found in the modular tension membrane (301) used in the seat assembly (30) can also be found with the modular tension membrane (401) used with the back assembly (40).

As mentioned previously the functional design of the modular tension membrane (301,401) channels the forces imposed by the user leaning into or sitting on it equally and laterally along the X-shaped ribbing (302, 412) extending outward from the center of the modular tension membrane (301, 401) to each corner thereof. The modular tension membrane perforations (303, 413) permit the membrane to breathe and thereby reduce the likelihood of perspiration on the part of the user.

Figure 8:
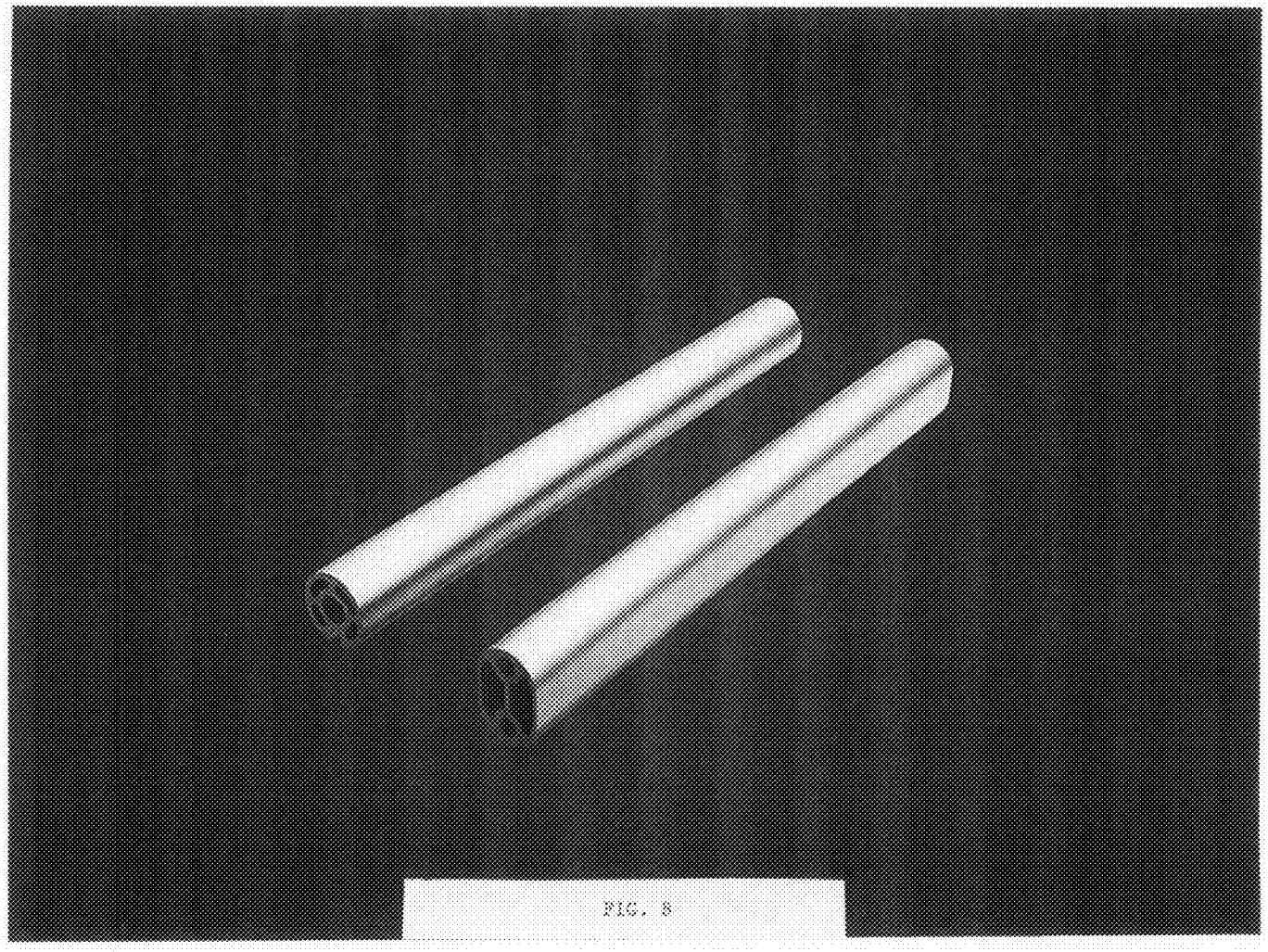
FIG. 8 is a photograph showing two support beams.

FIG. 8 is a photograph showing two support beams. The support beam (21) on the left has a circular cross-section while the one on the right has a race-track oval cross section. The support beam (21) on the left has a single connecting screw opening (213) while the one on the right has two. Both support beams have cavities (214) running the entire length of the support beam. The option of cast, molding, extruding, etc. the support beam (21) with these cavities (214) provides the public seating system (10) disclosed herein with a light weight and less expensive alternative to a solid support beam (21).

Figure 9:
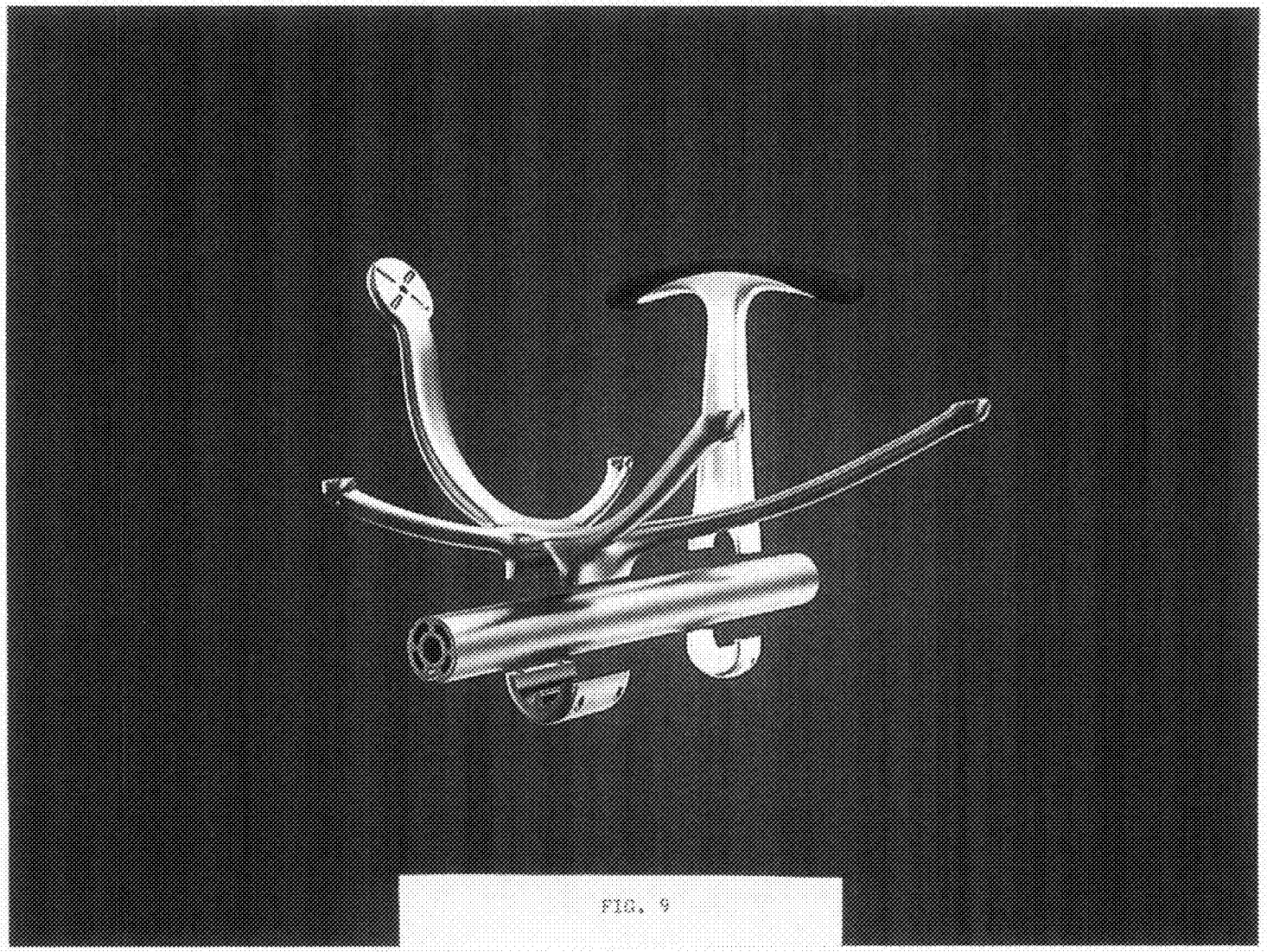
FIG. 9 is a photograph showing an exploded view of how the seat assembly and arm rest attach to the support beam.

FIG. 9 is a photograph showing an exploded view of how the seat assembly and arm rest attach to the support beam. FIG. 9 shows the cylindrical shape of the (on the lower left) seat support mounting sleeve (311) and the (lower right) arm rest mounting sleeve (321). FIG. 9 also shows the anti-rotation extension (312) on the seat support mounting sleeve (311) and the anti-rotation extension (322) on the arm rest mounting sleeve (321). These anti-rotation extensions (312, 322) fit snugly into the channel (211) located on the underside of the support beam (21) thereby keeping the seat assembly (30) and/or arm rest (32) from rotating. FIG. 9 also shows how each mounting sleeve (311, 321) couples to cylindrical base (315) of the seat support member (311) or arm rest (32) respectively each of which has a concave cylindrical base that surrounds the upper half of the support beam to couple with its respective mounting sleeve (311,321). FIG. 9 also gives an excellent perspective view of the concave-starfish shape of the seat support member and how its middle leg extends upward and has a flattened distal end that acts as the back support mounting plate (313).

Figure 10:
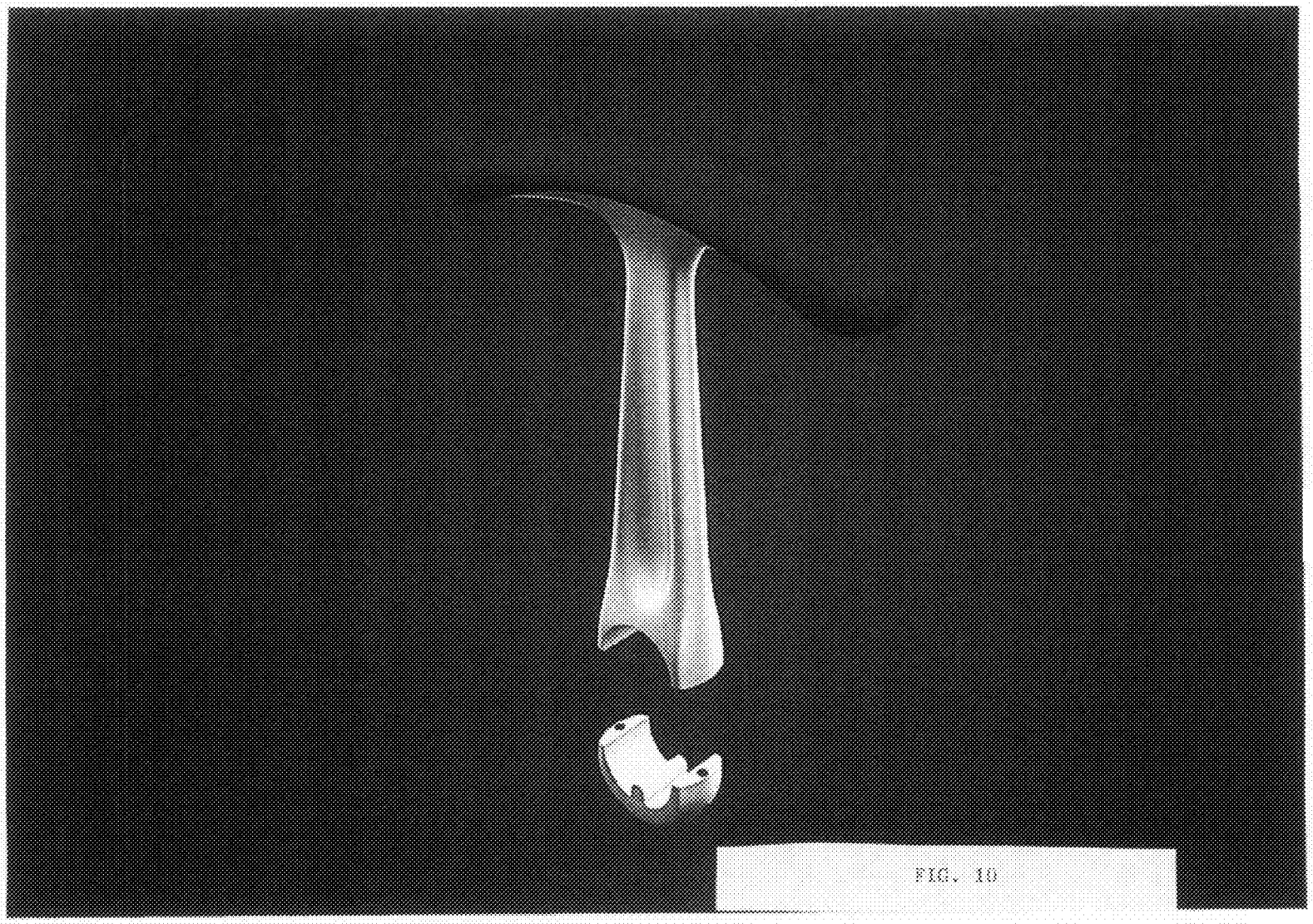
FIG. 10 is a photograph showing an exploded view the arm rest.

FIG. 10 is a photograph showing an exploded view the arm rest.

Figure 11:
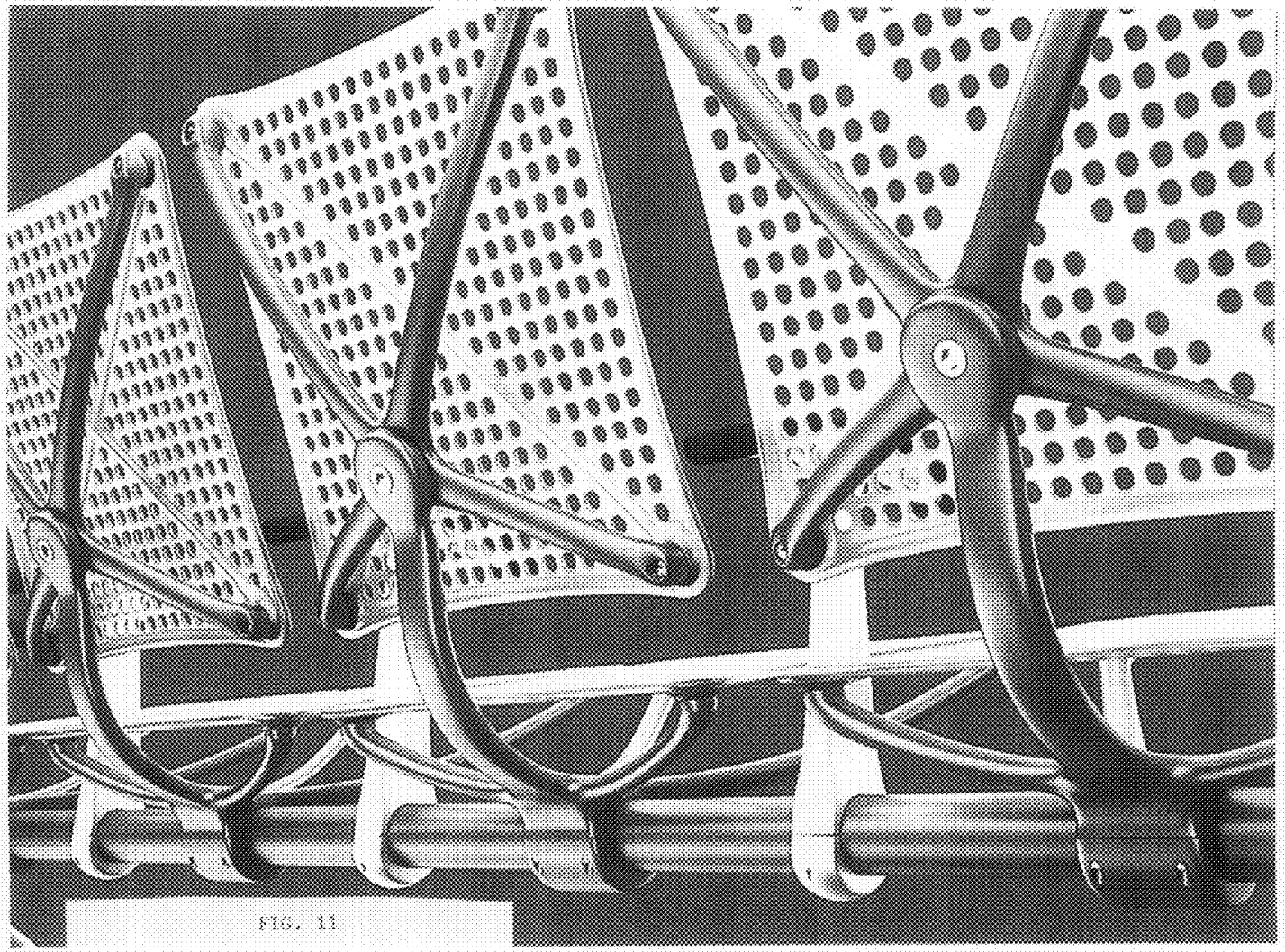
FIG. 11 is a photograph showing a rear perspective view.

FIG. 11 is a photograph showing a rear perspective view that shows how the back assembly (40) is attached to the seat support member (31). FIG. 11 also gives a good view of the modular tension membrane (401), the ribbing (412), and the perforations (413). FIG. 11 also shows how the seat assembly (30) and the arm rest (32) are coupled to their respective mounting sleeves (311) and (321) around the support beam (21). Finally, FIG. 11 shows the placement of the membrane attachment screws (411) and the back support attachment screw (412).

Another embodiment of the present invention contemplates a public seating system (10) without the back assembly (40) or the arm rests (32). Such an embodiment would be suitable for use in an environment where only momentary seating is anticipated such as a museum or an art gallery. Another embodiment of the present invention contemplates a single seat that might be more aptly suited for personal (home or office) use as opposed to a public seating venue. In essence, the present invention can be appropriate for use in any seating environment where the user appreciates the concept, efficiency, and economy of the interchangeable seat and back components. All other components and features found in the preferred embodiment (except the back assembly and the arm rests) would be found in this alternative embodiment.

What is claimed is:

1. A public seating system with interchangeable modular web-design perforated seats and web-design perforated backs comprising:

a. a support assembly consisting of a generally cylindrical and solid support beam with a longitudinal channel cut or etched into a bottom surface of said support beam, said channel running the entire length of said support beam, and a connecting screw opening on both ends of said support beam said connecting screw opening threaded to receive a connecting screw;

b. an inverted Y-shaped side support member with its prongs acting as feet for said side support member and its neck extending vertically to support a curvilinear and contoured arm rest attached perpendicularly thereto, said neck of said side support member having a cylindrical indentation cut into each of its sides directly opposite each other with a circular hole cut through the center of said indentation to accommodate said connecting screw, said indentations dimensioned so that said support beam fits snugly into said indentation on the inside of said side support member and said connecting screw fits snugly into said indentation on the outside of said side support member, said indentation on the inside of said support member having a ridge extending upward from the bottom surface of said indentation and dimensioned to fit snugly into said channel in said support beam;

c. one to six seat assemblies each of which is attached said support beam by means of a semi-cylindrical mounting sleeve surrounding a lower half of said support beam and being coupled to the semi-cylindrical base of said seat assembly, said mounting sleeve having a ridge extending upward from an inside-bottom surface of said mounting sleeve and dimensioned to fit snugly into said channel in said support beam, said seat assembly having four seat support members extending equilaterally outward and curving upward from the semi-cylindrical base and having a horizontally flattened distal end with threaded screw holes centered therein, said seat assembly having a fifth seat support member extending outward directly to the rear and curving upward from its base and having a generally vertically flattened distal end with a threaded screw hole centered therein;

d. an arm rest attached to said support beam, by means of a semi-cylindrical mounting sleeve surrounding said the lower half of said support beam and being coupled to the semi-cylindrical base of the arm rest, said mounting sleeve having a ridge extending upward from the inside-bottom surface of said mounting sleeve and dimensioned to fit snugly into said channel in said support beam;

e. a back assembly attached to each seat assembly, said back assembly having four back support members extending equilaterally outward and curving upward from its flattened base and having a horizontally flattened distal end with threaded screw holes centered therein, said base having a threaded screw hole centered therein, said back assembly fixably mounted onto said seat assembly, and f. a perforated, flexible, generally, rectangular, flat, reversible modular tension membrane dimensioned to precisely fit onto said seat assembly or said back assembly interchangeably, said membrane attached to said seat assembly and said back assembly at said screw holes at said distal ends of said seat assembly and said back assembly, said membrane having ribbing extending equilaterally outward from its center such that any force exerted on said membrane is distributed equally along said ribbing.

2. The public seating system according to claim 1 wherein said support beam has a curvilinear cross section other than circular.

3. The public seating system according to claim 1 wherein said support beam has one or more cavities running its entire length.

4. The public seating system according to claim 2 wherein said support beam has one or more cavities running its entire length.

5. A public seating system with interchangeable modular web-design perforated seats and web-design perforated backs comprising:

a. a support assembly consisting of a generally cylindrical and solid support beam with a longitudinal channel cut or etched into a bottom surface of said support beam, said channel running the entire length of said support beam, and a connecting screw opening on both ends of said support beam said connecting screw opening threaded to receive a connecting screw;

b. an inverted Y-shaped side support member with its prongs acting as feet for said side support member and its neck extending vertically to support a curvilinear and contoured arm rest attached perpendicularly thereto, said neck of said side support member having a cylindrical indentation cut into each of its sides directly opposite each other with a circular hole cut through the center of said indentation to accommodate said connecting screw, said indentations dimensioned so that said support beam fits snugly into said indentation on the inside of said side support member and said connecting screw fits snugly into said indentation on the outside of said side support member, said indentation on the inside of said support member having a ridge extending upward from the bottom surface of said indentation and dimensioned to fit snugly into said channel in said support beam;

c. one to six seat assemblies each of which is attached said support beam by means of a semi-cylindrical mounting sleeve surrounding a lower half of said support beam and being coupled to the semi-cylindrical base of said seat assembly, said mounting sleeve having a ridge extending upward from an inside-bottom surface of said mounting sleeve and dimensioned to fit snugly into said channel in said support beam, said seat assembly having four seat support members extending equilaterally outward and curving upward from the semi-cylindrical base and having a horizontally flattened distal end with threaded screw holes centered therein, said seat assembly having a fifth seat support member extending outward directly to the rear and curving upward from its base and having a generally vertically flattened distal end with a threaded screw hole centered therein; and d. a perforated, flexible, generally, rectangular, flat, reversible modular tension membrane dimensioned to precisely fit onto said seat assembly, said membrane attached to said seat assembly at said screw holes at said distal ends of said seat assembly and said back assembly.

* * * * *